United States Patent [19]

Luijten

[11] Patent Number: 4,846,601

[45] Date of Patent: Jul. 11, 1989

[54] METHOD FOR MECHANICALLY LAYING A HERRINGONE PATTERN OF BRICKS, AND AN APPARATUS TO PERFORM IT

[75] Inventor: Arend Luijten, Spijkenisse, Netherlands

[73] Assignee: Luijten Holding B.V., Groot-Ammers, Netherlands

[21] Appl. No.: 73,409

[22] Filed: Jul. 13, 1987

Related U.S. Application Data

[63] Continuation of Ser. No. 728,755, Apr. 30, 1985, abandoned.

[30] Foreign Application Priority Data

May 8, 1984 [NL] Netherlands ..... 8401469

[51] Int. Cl.[4] ..... E01C 19/52

[52] U.S. Cl. ..... 404/73; 404/99

[58] Field of Search ..... 404/73, 72, 29, 34, 404/99; 414/33, 121, 89; 294/63.1, 65; 198/411

[56] References Cited

U.S. PATENT DOCUMENTS

| | | | |
|---|---|---|---|
| 132,560 | 10/1872 | Brewer | 404/99 |
| 512,579 | 1/1894 | Flannery | 404/73 |
| 1,825,320 | 9/1931 | Kuerts | 404/99 X |
| 3,392,851 | 7/1968 | Pearne et al. | 414/72 X |
| 3,427,936 | 2/1969 | Van Der Meijden | 404/73 |
| 3,893,574 | 7/1975 | Kamphues | 294/63.1 X |
| 4,249,358 | 2/1981 | Thieffry | 404/99 X |
| 4,495,132 | 1/1985 | Johnson | 198/411 X |
| 4,685,714 | 8/1987 | Hoke | 294/65 X |

FOREIGN PATENT DOCUMENTS

| | | |
|---|---|---|
| 164083 | 2/1949 | Austria . |
| 7104261 | of 0000 | Netherlands . |
| 83/0011 | of 0000 | PCT Int'l Appl. . |

*Primary Examiner*—Jerome W. Massie, IV
*Assistant Examiner*—Matthew Smith
*Attorney, Agent, or Firm*—Ladas & Parry

[57] ABSTRACT

A method and apparatus for laying bricks in a herringbone pattern, in the preferred embodiment by a tongs motion, and for packeting bricks in a herringbone pattern.

2 Claims, 8 Drawing Sheets

METHOD FOR MECHANICALLY LAYING A HERRINGONE PATTERN OF BRICKS, AND AN APPARATUS TO PERFORM IT

This is a continuation of co-pending application Ser. No. 728,755 filed on Apr. 30, 1985, now abandoned.

This invention relates to a method for mechanically laying a herringbone pattern of bricks.

Such a method is described in the PCT-patent application No. 83/00011, where the bricks are turned in spaced rows and the rows are then shoved into engagement.

It has appeared extremely difficult until now, when laying bricks, to prevent that an irregular arrangement is produced whereby a not well joined pattern is obtained.

Moreover it is nowadays desired in filling stations to seal the joints between the bricks to prevent leakage of gasoline therebetween, and it is then an advantage that regular joints are provided, wherein the sealant will be applied. It should be realised, however, that in order to form a herringbone pattern with regular joints, the bricks should accurately be adapted thereto. Often bricks are used, which do not fulfill the condition for a herringbone pattern with regular joints that for a onestone array it is required that $L=2B+w$, i.e. the length L of a brick should be twice its breadth B plus the joint width w. For a $1\frac{1}{2}$ stone array counts $L=3B+2w$, and for a twostone array $L=4B+3w$, and generally for an n-stone array $L=2nB+(2n-1)w$.

Accordingly, in the first place it should be kept in mind that in any case bricks with correct dimensions are used, which are accurately adapted to the desired joint pattern to be laid.

Having realised this, the aim is now to provide an efficient method and apparatus, by which on large areas in section-building a herringbone pattern of bricks can be laid mechanically, and surprisingly it appeared that it can certainly be effected to fully automatically depose a herringbone pattern of bricks, particularly due to the clearance which is obtained as a result of the joint width to be observed.

According to the present invention deposing a herringbone pattern of bricks is effected so that an array of support means is used, each to engage each time a brick with a breadth B and a length L, in which array the support means, in order to observe a clearance s, tolerance, or joint width w, are spaced transversely at a pitch of $(B+w)\sqrt{2}$, and then shifted in the stretching direction, while each time being turned 45° in opposite sense in alternating transverse rows, from a pitch of $L+w$ to a pitch of $(B+w)\sqrt{2}$, in case of a onestone array, and it is to be noted that the process is reversible in order to be able to also take up again a herringbone arrangement and to depose the bricks back again in a brick pack.

The transfer of bricks to be laid, between the pack of bricks and the deposed herringbone arrangement, and reversely, when taking up bricks, is fully automatically performed so that the pursued aim to make section-building on large areas possible is thereby fulfilled.

Generally stated the present invention comprises a method for mechanically laying a herringbone pattern of bricks, wherein the bricks are laid in their herringbone pattern by the use of lazy-tongs.

In this respect reference is made to Dutch patent application No. 7104261 from which the use of lazy-tongs is known indeed for spacing bricks but not for laying a herringbone pattern of bricks.

In the above the issue is mainly that between the bricks a predetermined joint width w is preserved but it is not intended at all to restrict the invention thereto as it can also be applied to a herringbone pattern of bricks between which only some clearance s or substantially only the size tolerance of the bricks is preserved.

The main principle in this respect is that one does not so much count with the brick size, but rather with the surface that is occupied by the brick. The surface is increased with the required clearance s or size tolerance or, if so desired, increased with the joint width. Thus the ground is covered with a pattern of small surfaces in which the bricks fit each time.

A preferred embodiment according to the present invention comprises a method for laying, particularly in pavement, twilled rows of bricks which are supplied in the form of a pack of squarely arranged bricks, comprising the steps of: withdrawing from said pack successive transverse rows of bricks;

transversely interspacing the bricks in each successive row at adequate distances; turning the bricks in subsequent rows 45° in opposite twill directions;

and longitudinally moving successive rows of bricks to twilled abutment, characterized by the fact that said step of turning the bricks in alternate twill directions and said step of transversely and/or longitudinally moving successive rows of bricks to twilled abutment are affected at one and the same time in a lay system comprising a chute system in which the bricks are directed in the longitudinal direction when entering into said system, and the bricks are turned 45° when exiting from said system in subsequent rows in stepwise advance of said system relative to laid twilled rows of bricks, said chute system comprising chutes passing the bricks alternately to one and the other twill direction at 45° from the direction of supply.

An alternative embodiment according to the present invention comprises a method for laying, particularly in pavement, twilled rows of bricks which are supplied in the form of a pack of squarely arranged bricks, comprising the steps of:

withdrawing from said pack successive transverse rows of bricks; transversely interspacing the bricks in each successive row at adequate pitch distances;

turning the bricks in subsequent rows 45° in opposite twill directions;

and longitudinally moving successive rows of bricks to twilled abutment, characterized by the fact that said step of turning the bricks in alternate twill directions and said step of transversely and/or longitudinally interspacing the bricks in each successive row are effected by means of a lay system comprising lazy-tongs carrying suction pads which are adapted to be interspaced at a pitch of $(B+w)\sqrt{2}$, to bring successive rows of bricks which are at a pitch of $L+w$ from the same level to separate levels (see FIG. 7*b*), to turn said successive rows in opposite twill directions, and to return said rows to the same level again (broken lines of right hand portion of FIG. 7*b*) so that the bricks fittingly interengage in a joined herringbone pattern, L being the length and B the breadth of the bricks and w the width of the joint(s) between bricks.

A suitable manner to give the packeted and/or packed bricks the necessary support in view of retaining the form is by a height-staggered arrangement of the rows of bricks in their herringbone pattern. In this way the bricks are not shiftable in their stacked relationship, whereas otherwise the layers of bricks could shift with respect to one another.

In the preferred embodiment of this way of forming a stack packet this is effected so that between the layers each time height-staggered support sheets are inserted, and it is advisable that the pallets and said support sheets are provided with brick receiving pockets with beveled sides or small slopes, providing the necessary clearance for guiding the bricks to their places. In this way it is also possible to retain bricks, having some deviation in size, in the receiving pockets which are adapted to the nominal brick size.

A further aspect is that the bricks, supported by said support sheets, can be arranged in the road surface each time through openings which pass the bricks therethrough when pressing thereon with sufficient force.

When performing the earlier described alternative method according to the present invention, lowering and raising bricks which are to be brought at a different level before being turned, preferably takes place by a lifting mold which each time adjusts the suction-pads with the bricks which are to be brought at a separate level and then to be returned at the same level again.

Within the scope of the invention furthermore a method for packeting bricks is provided, wherein a herringbone pattern of bricks is laid in a binder bath on a base layer within a framing mold of defined contour and dimensions, which is removed upon hardening of the binder.

The invention will be further described in view of illustrative embodiments as represented in the drawings.

Figure 5:
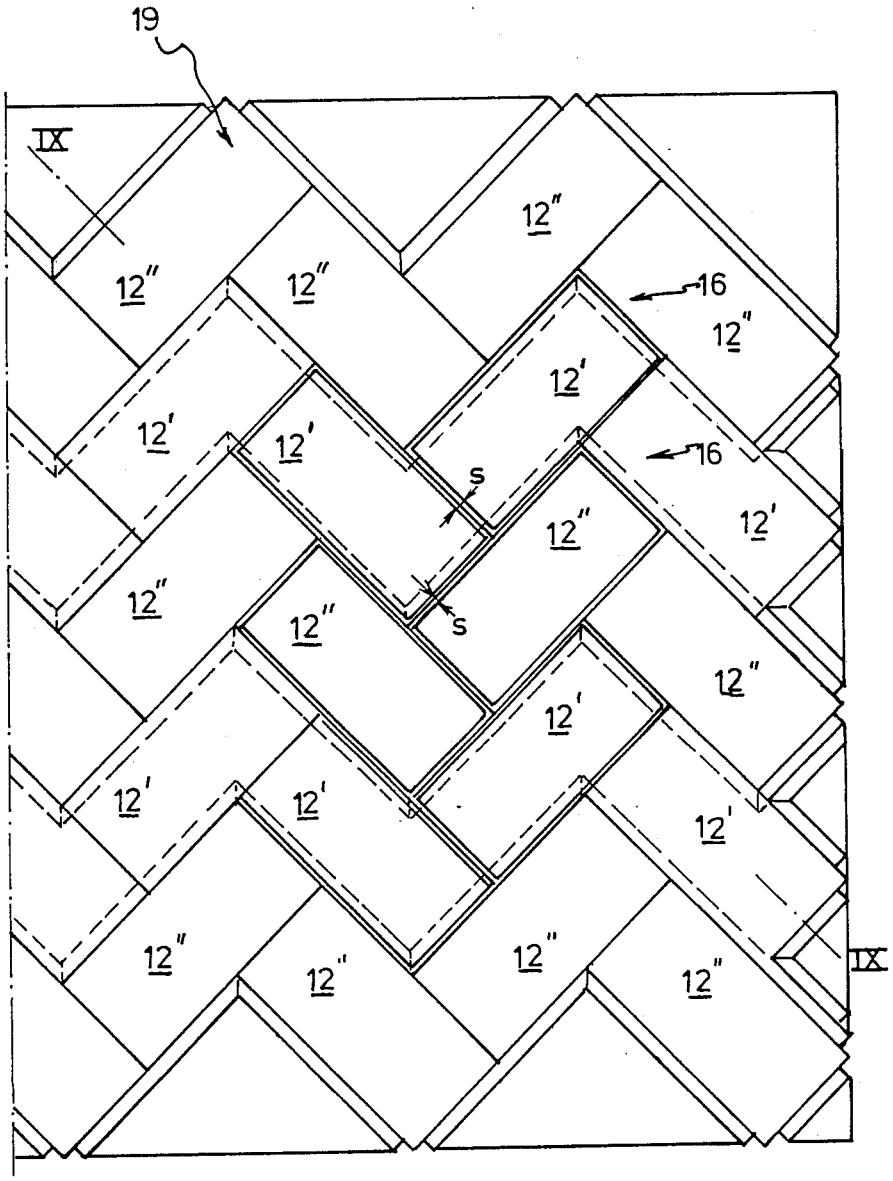
FIG. 5 shows by way of example a pack of bricks in plan view.
Figures 6A, 6B, 7A, 7B:
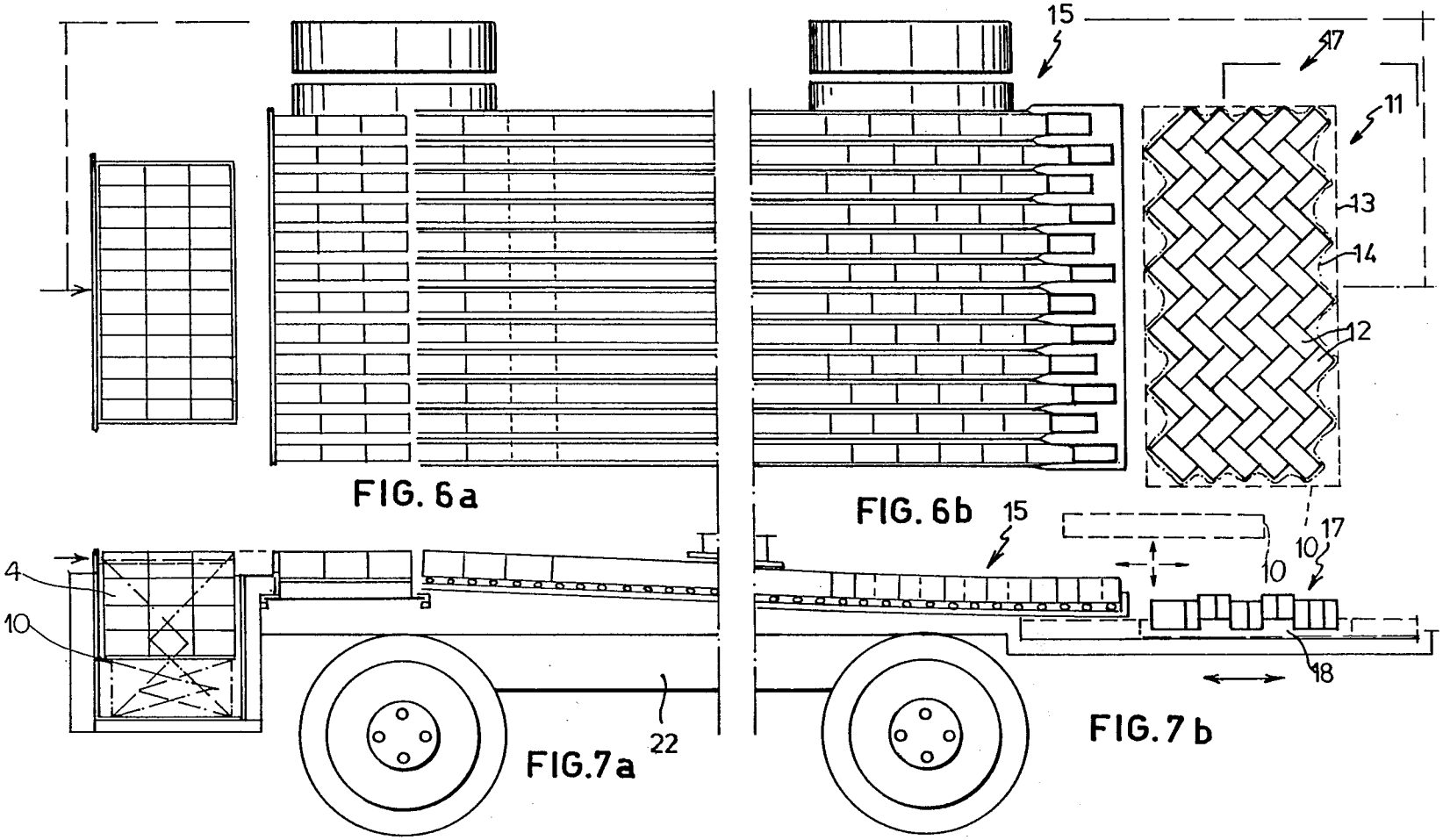
Figure 8:
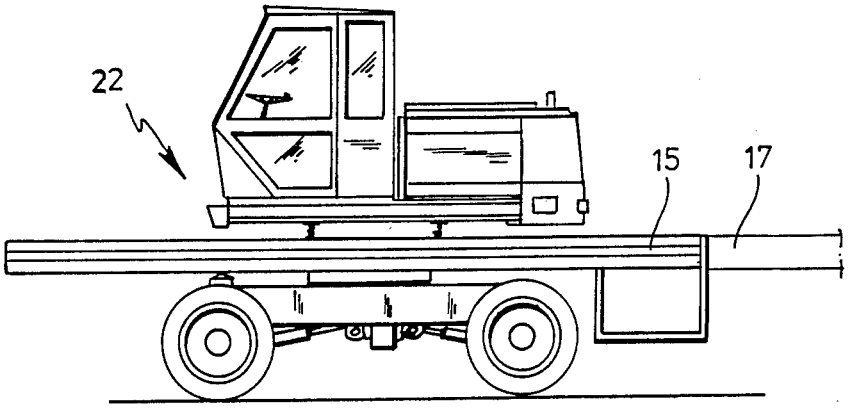
Figure 9:
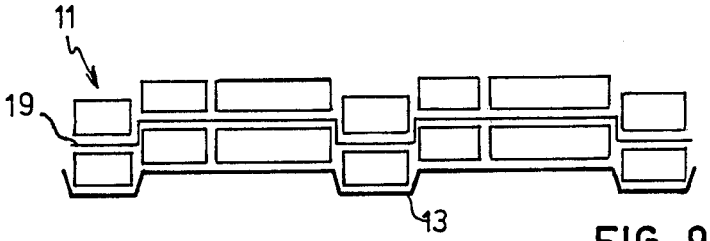
Figure 10:
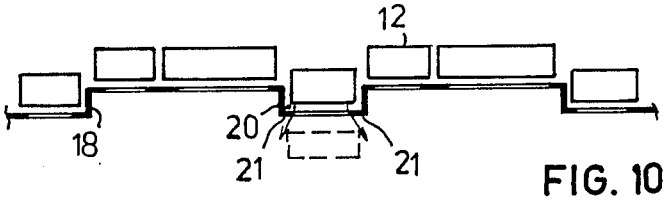
Figure 11:
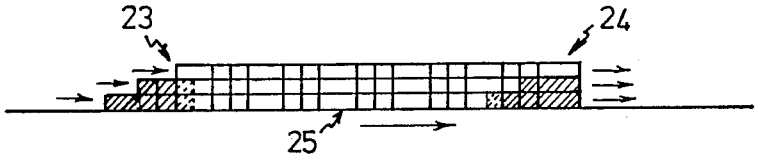
Figure 12:
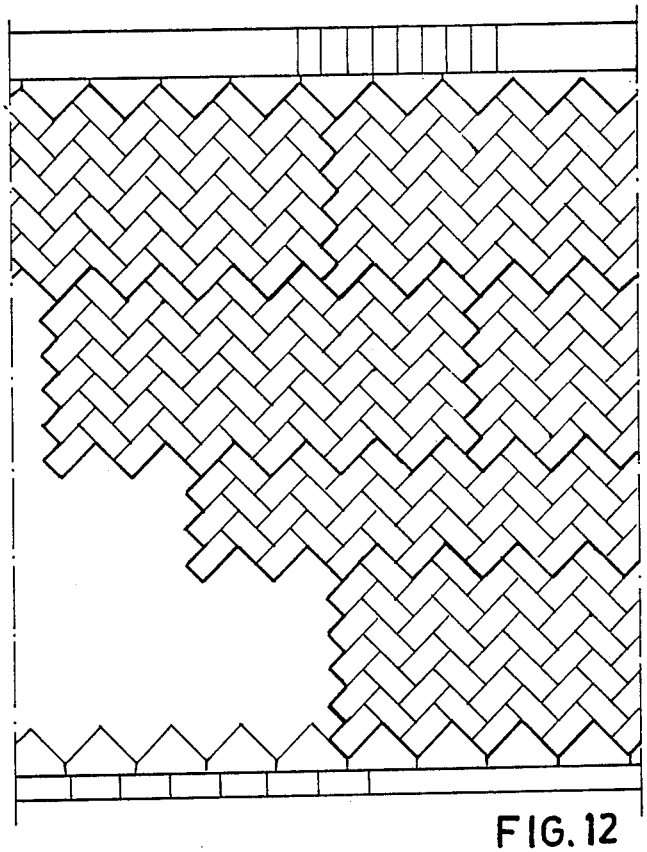
Figure 13:
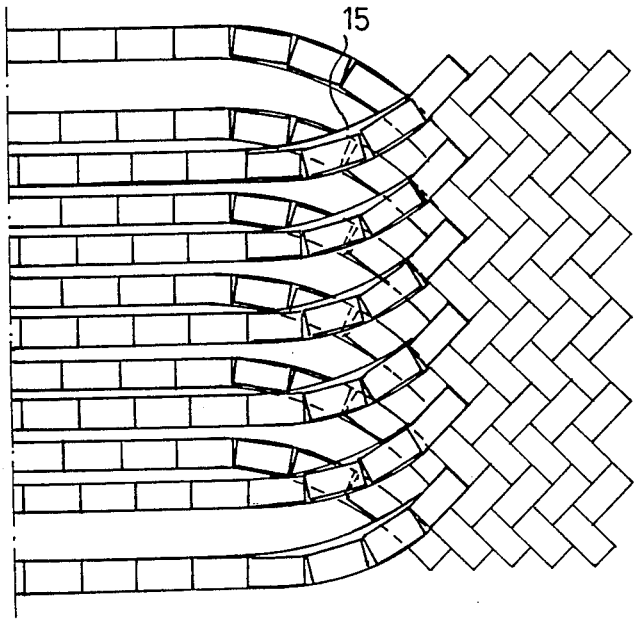
Figure 14:
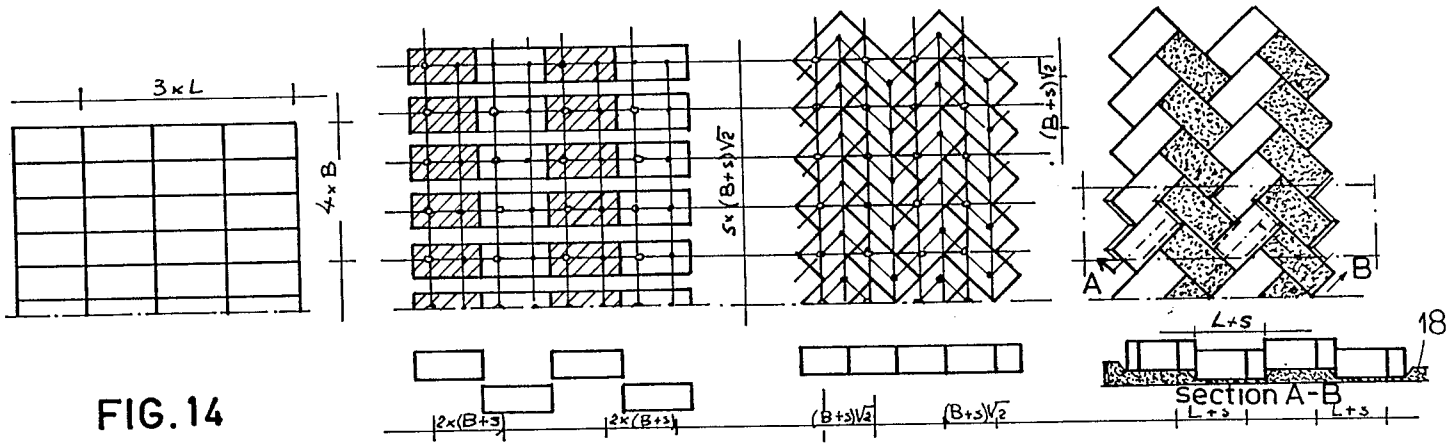
Figure 15:
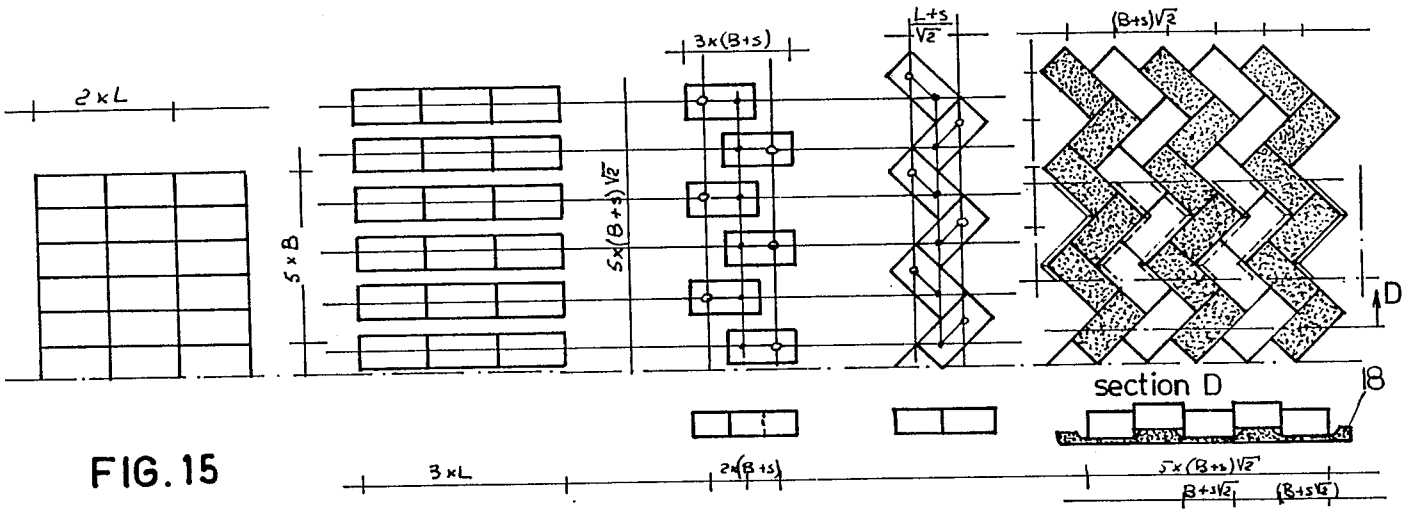
Figure 16:
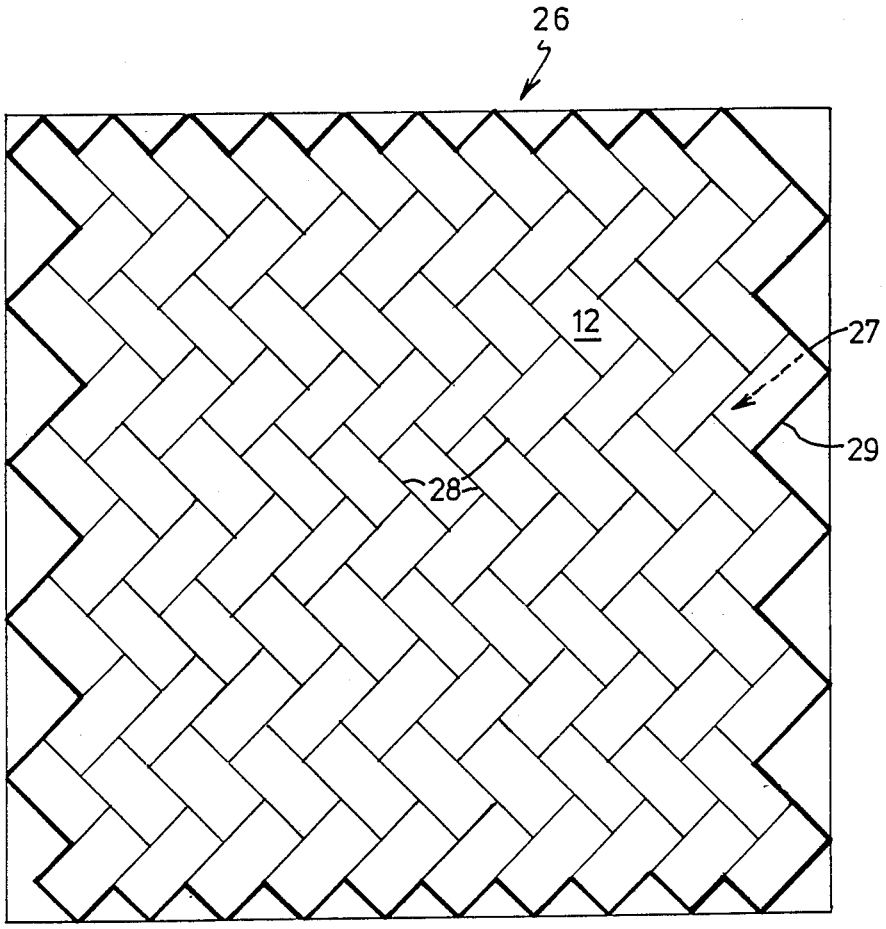

FIGS. 6*a, b* shows to a smaller scale a laying pattern in plan view;

FIGS. 7*a, b* is a lateral view of the laying pattern of FIG. 6;

FIG. 8 shows a vehicle equipped for packing;

FIG. 9 is a cross-section of a packet consisting of bricks which are placed on support sheets, according to the line IX—IX in FIG. 5;

FIG. 10 is a cross-section of a support sheet through which the bricks can be pushed;

FIG. 11 is an illustration of the new principle according to which the bricks are stacked at the input side in rows at separate levels, and are destacked at the outlet side in a herringbone pattern in one plane;

FIG. 12 shows layers of bricks laid in the road surface;

FIG. 13 is a plan view of a chute system for each time turning the bricks 45° into their herringbone pattern;

FIG. 14 shows the sequence of steps for laying a number of rows at the same time in their relationship;

FIG. 15 shows the course of the process when the bricks are laid one row at a time; and FIG. 16 shows a preformed road surface panel.

Figure 1:
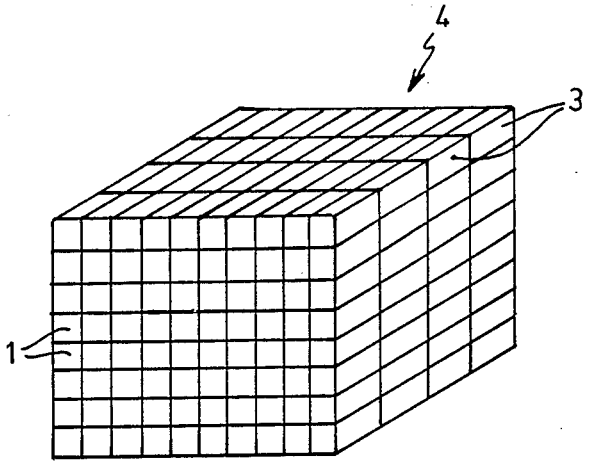
FIG. 1 represents a pack of bricks.
Figure 4:
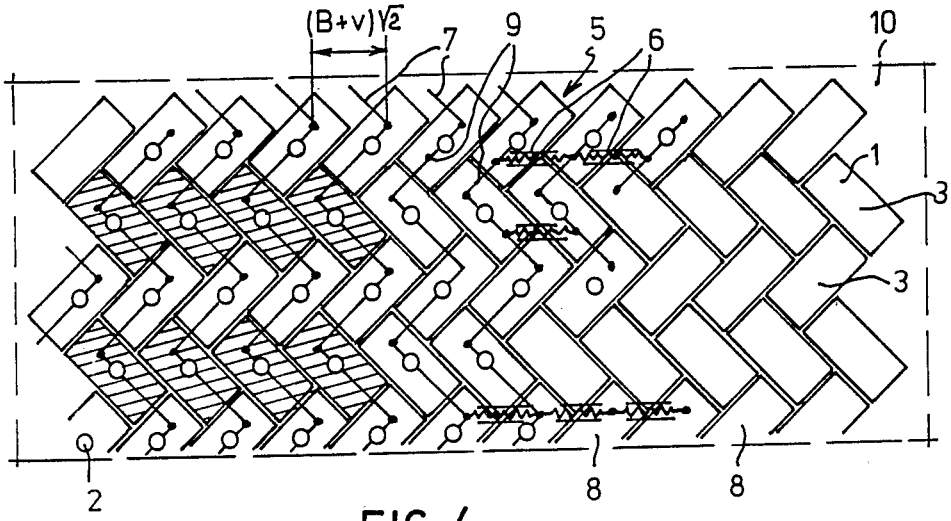
FIG. 4 is a plan view of a schematically represented pattern of bricks engaged by support means.
Figure 2:
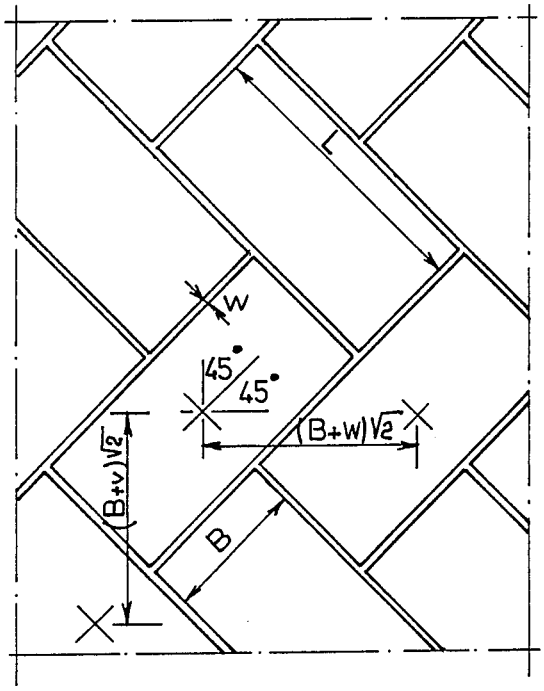
FIG. 2 represents a 1-stone herringbone arrangement.
Figure 3:
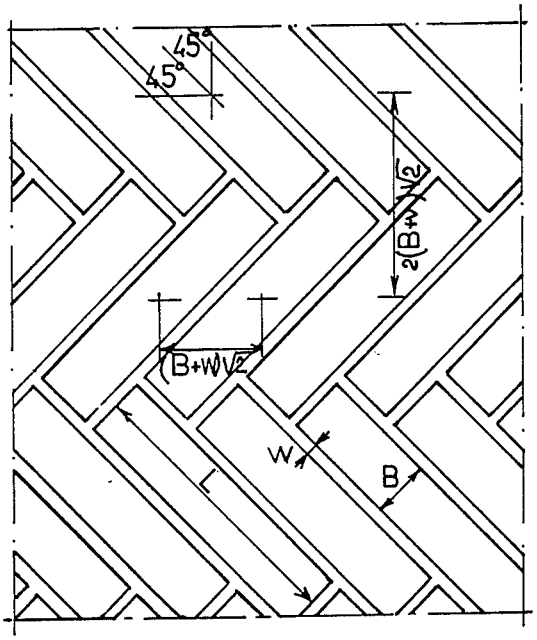
FIG. 3 represents a 2-stone herringbone arrangement.

The bricks 1 are handled by means of suction-pads 2 which are schematically represented in FIG. 4, and are layered in transverse rows 3 in a supplied brick pack 4 as represented in FIG. 1.

The array of suction-pads 2 as illustrated in FIG. 4 comprises multiple lazy-tongs 5 having spacers 6 in the form of spring means between the respective lazy-tongs 7 in order to obtain equal interspacing transversely.

The bricks 1 in the brick pack 4 are spaced transversely at a distance of B plus some clearance s, but are spaced transversely at a distance of $(B+w)\sqrt{2}$ before the bricks are turned 45°, whereby the desired joint width w is thus taken into account.

Before turning and shifting the longitudinal rows 8 of bricks into their herringbone pattern, the suction-pads 2 holding the bricks which are hatched in FIG. 4, are first lowered to a separate level. When the lazy-tongs legs 9 have been adjusted at 45°, the lowered suction-pads and bricks are raised again to the initial level, and all bricks will then accurately fit in the herringbone pattern.

Said raising and lowering can be performed by means of a lifting table 10 which is only schematically indicated in phantom lines in FIG. 4. FIG. 4 shows some bricks 1 cross-hatched to more clearly bring out the alternating brick rows 3 in their herringbone pattern. Also only a few of a great number of spacing springs 6 which are connected to the centers of brick "squares" are shown so as not to blur the view in FIG. 4.

As illustrated in FIG. 5, in a stacked pack 11 of bricks 12 in a herringbone pattern the bricks 12' and 12'' are located every other high and low, with all about some clearance s therebetween, as appears particularly from the lateral view of the pack 11 as represented in FIG. 7. Due to this height-staggered relationship any shifting in the pack 11 is prevented, particularly when a shrink foil 14 is shrunk on a packet 11 which is formed on a pallet 13, of which pallet 13 and of which shrink foil 14 the contour is illustrated schematically by dotted lines and dash-dot lines in FIG. 6.

In fact, FIG. 5 fundamentally shows basic "squares" forming rectangles which are at a pitch of $(B+w)\sqrt{2}$, and in FIG. 5 some of said basic rectangles are filled with bricks leaving a clearance s or joint width w all about. The dashed lines indicate the bottoms of the brick nests in the support sheet 19 or lay mold 18.

FIGS. 6 and 7 show in plan view and in lateral view, respectively, a supply device 15, forming rows 16 of bricks 12 in spaced and staggered relationship, which rows 16 of bricks are laid in a herringbone arrangement, while performing a tongs motion such as by means of a lazy-tongs system as illustrated in FIG. 4 or by means of chutes as described in the following in view of FIG. 13, on a stacking device 17 laying the rows 16 of bricks every other high and low on for instance a lay mould 18, as can be seen in FIG. 7, or on a similarly formed pallet 13 on which the rows 16 of bricks are packed in various layers.

FIG. 8 is an illustration of a vehicle 12 equipped for packeting bricks in the proposed manner, and also comprising the supply device 15 and the stacking device 17.

FIGS. 9 and 10 show schematic cross-sections according to the line IX—IX in FIG. 5.

Between the layers modelled support sheets 18 can be inserted each time, in which pockets 20 adapted to receive the rows 16 of bricks, located every other high and low, are formed, which pockets are preferably formed homingly, with a lower portion of the pocket 20 that corresponds with the size of the bricks, while the upper portion of the pocket 20 is wider. The pockets 20 may be provided with semi-rigid somewhat deformable supporting edges 21 for the bricks 12, through which the bricks 12 can be pushed by exerting a force so as to lower these into the road surface.

Instead of by means of tongs the rows 16 of bricks can also be placed in their herringbone pattern along chutes, as illustrated in FIG. 13, but the use of tongs is presently preferred. In its simplest embodiment the tongs may consist of two relatively slidable laying strips, as will be readily understood. The formed rows of bricks in a herringbone pattern are supplied each time every other high and low on the stacking device 17. As can be seen in FIG. 7 the stacking device 17 can be arranged under the end of the supply device 15 for telescoping it in and out so as to transfer each subsequent row 16 of bricks from the supply device 15 to its destination on the stacking device which is correctly positioned therebelow.

FIG. 11 shows how the bricks are stacked at 23 in rows at three separate levels, by the use of multiple lazy-tongs (not shown), and are destacked at the output side 24 in a herringbone pattern in one plane, while an endless belt 25 is used, preferably a wafer belt with small slopes to retain the bricks in the desired relationship. It is remarked that each time the last laid lowermost rows of bricks will form the first rows of the next packet later on. In FIG. 11 the pertaining rows of bricks are indicated by hatching.

FIG. 12 shows packet layers laid in the road surface by means of a high/low lay system such as illustrated in FIG. 10, with the outermost rows of the packet layers that are laid, situated low and adjoining the outermost rows of bricks of the adjacent packet layers, which are also situated low.

The chutes as illustrated in FIG. 13 act alternatingly high and low, passing one over another.

It is pointed out that when the bricks do not fit well in their herringbone pattern due to some deviation in size, if so desired use can be made of a joint binder so as to keep packed bricks or bricks to be laid in their linked relationship which may of course also be a flat-laid relationship, and it is furthermore remarked that it is also possible to use laying sheets with push-through funnels for that purpose.

In that case the tongs motion to be performed can be used as well, with tongs consisting of mutually slidable support rods in a parallel rod assembly.

FIGS. 14 and 15 give a view of the sequence of steps when a number of rows are placed in their relationship at the same time and when the bricks, after turning with lazy-tongs, are shoved-on one row at a time, respectively. FIGS. 14 and 15 clearly show support means are to be manipulated to transfer bricks from a brick pack as shown at the left into a herringbone pattern as shown at the right.

Of course, effecting the new method is subject to all sorts of modifications within the scope of the present invention and it is thus to be noted that the herein represented illustrative embodiments should not be interpreted in a restrictive sense.

Accordingly, spacer spring means can be spanned as straight guiding means between all the centerline-pivots of the lazy-tongs legs 9, which spring means are laterally seated on the lateral adjusting rules, and in so far as being compression springs, are each enclosed in a casing to avoid buckling, and furthermore, in order to avoid a dead-center position of the lazy-tongs, a lead i.e. a preliminary deflection in the deflecting direction can be given to the outermost lazy-tongs legs.

Furthermore the spaces or joints between the bricks can be suitably preformed by using a method comprising pre-milking the lateral surfaces of the bricks with binder milk i.e. thin jointing mortar milk or actually substantial mud or mud sludge of clay loam with an addition to increase the binding ability.

The road surface panel as illustrated in FIG. 16 is preformed by laying bricks 12 on a base layer 27 on which a binder milk bath of particularly clay or loam with, when necessary, an addition of a binding agent such as cement is formed, which clay binder also penetrates into the joints 28 between the bricks. According to this method the bricks are now not laid one at a time in the small surface destined for that purpose, but for instance one hundred bricks are laid in the surface destined for that purpose. This can be done within a suitable framing mould 29 which can be removed from the formed packet layer 26 upon hardening of the binder. This forming method is not only to be used for road surface panels but also for floor and wall panels in general. A lay system such as lazy-tongs table 10 as schematically indicated in FIG. 4, the lay mold 18 as shown in FIG. 7 or support sheets 19 as shown in FIGS. 9 and 10 may be used to form such prepacked panels 26 at a factory or in situ.

I claim:

1. A method for mechanically laying bricks, having a top, sides, and ends, with the sides dimensionally longer than the ends, in a herringbone pattern comprising the steps of:

providing layers of a plurality of bricks defining a stack;

engaging one layer of bricks with a plurality of support means, the bricks having their lengths and widths parallel, defining one pattern, and each brick spaced from their respective centerlines a distance B plus a gap w between the sides of each brick;

manipulating the support means to reorient the bricks from the one pattern to a herringbone pattern with the centerlines of any two parallel side by side bricks spaced (B+W) multiplied by the square root of two.

2. A method for laying, particularly in pavement, twilled rows (16) of bricks (1,12) which are supplied in the form of a pack (4,11) of squarely arranged bricks (1,12) comprising the steps of:

withdrawing from said pack (4,11) successive transverse rows (3) of bricks (1,12) transversely interspacing the bricks (1,12) in each successive row (3) at adequate pitch distances;

turning the bricks (1,12) in subsequent rows (3) 45° in opposite twill directions; and longitudinally moving successive rows (3) of bricks (1,12) to twilled abutment;

wherein said step of turning the bricks (1,12) in alternate twill directions and said step of transversely and/or longitudinally interspacing the bricks (1,12) in each successive row (3) are effected at one and the same time by means of a lay system (10) comprising lazy-tongs (5,7) carrying suction-pads (2) which are adapted to be interspaced at a pitch of $(B+W)\sqrt{2}$, to bring successive rows (3) of bricks (1,12) which are at a pitch of L+W from the same level to separate levels, to turn said successive rows (3) in opposite twill directions, and to return said rows (3) to the same level again so that the bricks (1,12) fittingly interengage in a joined herringbone pattern, L being the length and B the breadth of the bricks (1,12) and w the width of the joints (5) between bricks (1,12).

* * * * *